US008256212B2

(12) United States Patent
Miretti

(10) Patent No.: US 8,256,212 B2
(45) Date of Patent: Sep. 4, 2012

(54) EXPLOSION PROTECTION SYSTEM WITH INTEGRATED EMISSION CONTROL DEVICE

(76) Inventor: Angelo B. Miretti, Milan (IT)

( * ) Notice: Subject to any disclaimer, the term of this patent is extended or adjusted under 35 U.S.C. 154(b) by 939 days.

(21) Appl. No.: 12/006,997

(22) Filed: Jan. 8, 2008

(65) Prior Publication Data

US 2008/0256938 A1 Oct. 23, 2008

Related U.S. Application Data

(60) Provisional application No. 60/880,235, filed on Jan. 12, 2007.

(51) Int. Cl.
*F01N 3/00* (2006.01)
*F01N 3/02* (2006.01)
*F01N 5/02* (2006.01)

(52) U.S. Cl. ..... 60/298; 60/297; 60/311; 60/320

(58) Field of Classification Search ..... 60/297, 60/298, 299, 302, 311, 320; 55/DIG. 20; 110/119; 181/88.2, 231
See application file for complete search history.

(56) References Cited

U.S. PATENT DOCUMENTS

| | | | | |
|---|---|---|---|---|
| 3,645,093 | A * | 2/1972 | Thomas | 60/303 |
| 5,488,826 | A * | 2/1996 | Paas | 60/299 |
| 5,904,042 | A * | 5/1999 | Rohrbaugh | 60/298 |
| 6,116,022 | A * | 9/2000 | Woodward | 60/300 |
| 6,875,407 | B1 * | 4/2005 | Biel et al. | 422/179 |
| 6,951,099 | B2 * | 10/2005 | Dickau | 60/300 |
| 2003/0029165 | A1 * | 2/2003 | Nakatani et al. | 60/288 |
| 2006/0094312 | A1 * | 5/2006 | Zwieg et al. | 440/89 R |
| 2007/0240406 | A1 * | 10/2007 | Zhang et al. | 60/297 |

FOREIGN PATENT DOCUMENTS

JP 63017983 A * 1/1988

OTHER PUBLICATIONS

Nakayama et al., English Abstract of JP 63-017983 A, Jan. 25, 1988.*
Mine Safety and Health Administration, Title 30 Code of Federal Regulations, archived as early as Aug. 3, 2004.*

* cited by examiner

*Primary Examiner* — Thomas Denion
*Assistant Examiner* — Audrey K Bradley
(74) *Attorney, Agent, or Firm* — Henry I. Schanzer

(57) ABSTRACT

The exhaust system of an internal combustion engine includes a duct having an input end coupled to the engine for passing and processing the exhaust gases and fumes emitted by the engine such that the duct functions as an anti-explosion and fire arrester device. The duct includes a reinforced filter structure securely and firmly mounted within and across the duct opening. The filter structure is coated with a noble metal to enhance oxidation of the gases and fumes passing through the duct. An insulator layer is attached about and along the outer surface of the duct and a jacket for carrying a coolant is mounted above and about the insulator layer. The insulator layer isolates the coolant from the duct to ensure that the temperature on the external side of the jacket is less than a predetermined value. Simultaneously, the insulator layer isolates the duct from the coolant to enable the temperature within the duct to have a sufficiently high value to sustain oxidation of the gases and fumes. The input end of the duct may be connected to the engine via a first heat exchanger and the exhaust end of the duct may be connected by additional heat exchangers to the exhaust system output.

14 Claims, 8 Drawing Sheets

EXPLOSION PROTECTION SYSTEM WITH INTEGRATED EMISSION CONTROL DEVICE

This application claims priority from provisional application Ser. No. 60/880,235 filed Jan. 12, 2007 for Explosion Protection System with Integrated Emission Control Device

BACKGROUND OF THE INVENTION

This invention relates to explosion proof exhaust systems and in particular to an explosion poof exhaust system which includes a flame arrester integrated with an emission control device.

Many pieces of equipment (e.g., internal combustion operated industrial machinery) have to be operated in areas where gases and flammable substances are present. The heat generated by the engines and the exhaust fumes of these pieces of equipment may cause the gases and/or flammable material present in the area to ignite and/or explode. It is therefore necessary to reduce the external surface temperature of the pieces of equipment and to prevent sparks/flames from being emitted out of the exhaust. It is further necessary and/or desirable to reduce the pollutants emitted by the pieces of equipment for, among others, not adding to the gases and flammable substances already present.

Presently available systems, as shown in Prior Art FIG. 1, generally include: (a) a cooling unit which may include one, or more, cooling radiators coupled to the cylinder head of an engine to limit the temperature of gases exhausted to the atmosphere form the engine (these are generally made to have large dimensions due to traditional technology); (b) a flame arresting unit which requires frequent cleaning and routine maintenance due to particulate collecting in the exhaust (flame) path; and (c) a separate spark arresting unit.

Known prior art systems are relatively complex and the need to perform frequent cleaning and maintenance imposes severe restrictions on their use.

SUMMARY OF THE INVENTION

Systems embodying the invention include an exhaust system mounted via explosion proof flanges to the engine cylinder head. The exhaust system includes a flame-arrester-oxidizing device comprising a duct having an input end and an output end and a passageway between the input and output ends for passing the exhaust gases. An oxidizing and filtering device comprising metal foils coated by a noble metal (e.g., platinum, or the like) is firmly and securely affixed across the passageway. In addition, an insulator layer is mounted over the external wall of the duct. A jacket is mounted over the insulator through which a coolant (water or the like) can pass to cool the external surface of the system, in contact with the atmosphere, to a temperature (e.g., 90 degrees centigrade) below a prescribed level. At the same time, the insulator layer insures that the coolant does not lower the temperature within the duct's passageway to a value which would prevent oxidation. By maintaining the temperature within the duct at an elevated temperature, the exhaust fumes and pollutants from the engine, passing through and along the metal foils, are oxidized resulting in mostly water vapour and gases being emitted at the exhaust output of the device. Thus, the flame arrester oxidizing device of the invention functions as a remover of pollutants and is generally self cleaning. This eliminates the need for frequent cleaning and maintenance present in the prior art.

In one embodiment the engine exhaust is fed to a first heat exchanger for cooling the very hot exhaust fumes prior to their passing through the flame-arrester-oxidizing device. The exhaust output from the flame-arrester-oxidizing device is then passed through to an additional flame arrester. The output of the additional flame arrestor is then passed through a dry secondary cooler which includes spark arresting properties.

BRIEF DESCRIPTION OF THE DRAWINGS

In the accompanying drawings, which are not drawn to scale, like reference characters denote like components.

DETAILED DESCRIPTION OF THE INVENTION

Figure 1:
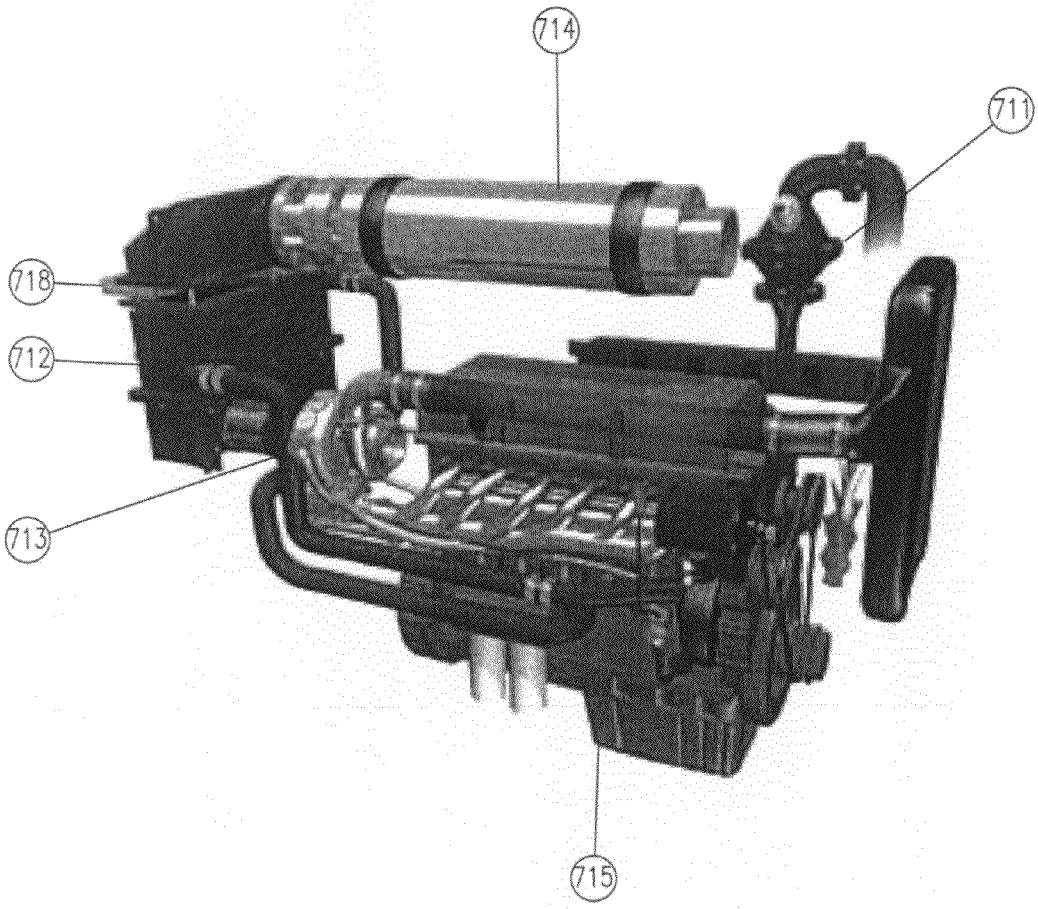
PRIOR ART FIG. 1
FIG. 1 is a simplified block diagram of a prior art explosion proof system for a diesel engine.
Figure 2:
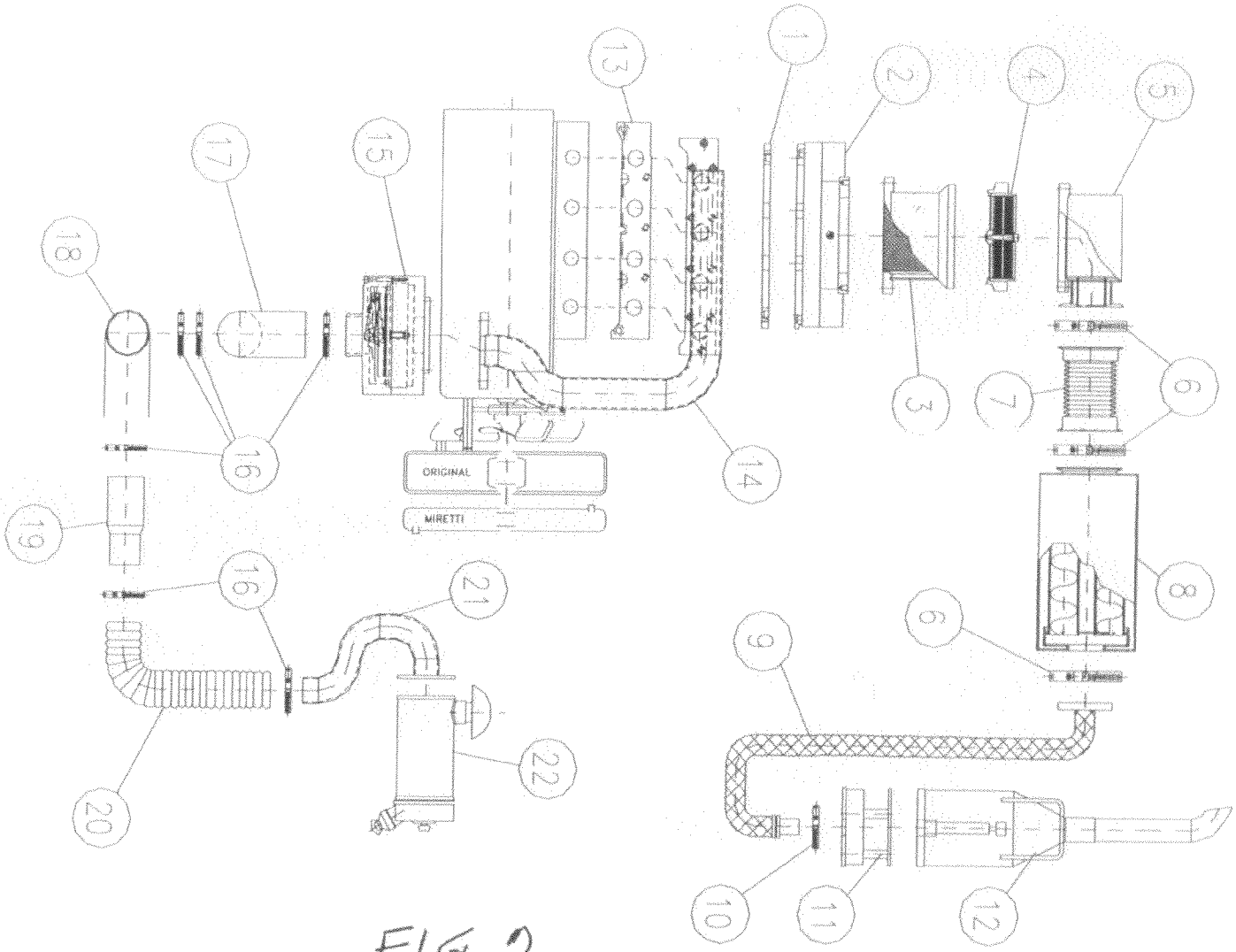
FIG. 2 is a diagram showing the relative positions of various components of an intake/exhaust system assembly embodying the invention.

Selected components of the intake/exhaust assembly shown in FIG. 2 are identified by respective reference characters whose general, brief, descriptions are given in Table I, attached. The exhaust portion of the system shown in FIG. 2 includes an exhaust engine sealed flange 1 coupled to a primary heat exchanger 2 which in turn is coupled to a platinum coated preliminary flame arrestor 3 which in turn is coupled to a secondary flame arrestor/heat exchanger 4 which is coupled via a flow deflector 5, clamp 6 and flexible pipe 7 to an additional (third) heat exchanger (integrated spark arrestor) 8 which exhausts via flanged pipe 9 and components 10 and 11 to, and through, particle filter 12 to the atmosphere external to the exhaust system.

The intake portion of the system shown in FIG. 2 includes an air filter 22 whose intake is coupled via pipes, elbows and clamps 21, 20, 19, 18, 17 and 16 to intake flame arrestor and intake shut down valve 15. The flow out of component 15 is then fed to intake manifold 14 which is coupled to intake engine sealed special flange 13 and to the exhaust system. Flame arrester 15 may be formed in a similar manner as flame arrester 2, without the need for special oxidizing coating provided to arrester 3. Intake flame arrester 15 does not require any water cooling.

In addition to protecting the air intake system against unexpected flames, flame arrester 15 also has an air shut off valve built into it. This valve is used to cut off the air supply to the engine, causing the engine to shutdown, upon receipt of certain signals from the engine control system. The functioning of the control system is described below.

Figure 8:
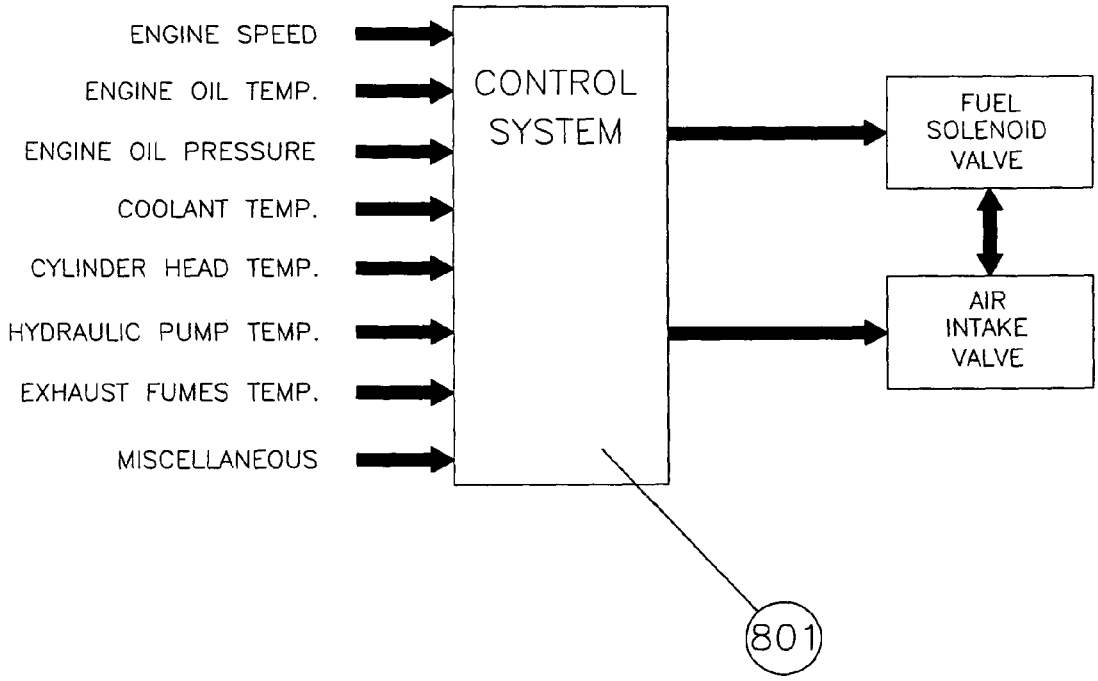
FIG. 8 is a simplified block diagram of a control system for controlling fuel valve and air intake valve.

The engine control system (see FIG. 8) constantly monitors critical operating parameters which are sensed by various sensors and supplied to the control system 801. By way of example these parameters include selected ones of the following: (i) engine speed; (ii) engine (motor) oil temperature; (iii) engine oil pressure; (iv) coolant temperature; (v) cylinder (motor) head temperature; (vi) hydraulic pump temperature; (vii) exhaust fumes temperature. The control system 801 includes processing electronics and comparison circuitry (not detailed) to determine if and when, predetermined limits are exceeded. When a specified limit is exceeded, the control system 801 supplies signals to the fuel solenoid valve and/or the air intake valve to shut off the supply of oil and/or air to the system.

For example, the exhaust air and the radiator coolant have respective maximum temperature limits. When their maximum temperature is exceeded, the system transmits a signal activating (shutting off) the air intake valve. Engine oil pressure has a minimum acceptable limit. Upon detecting lower than acceptable pressure, the control system activates the air shut off valve. Similarly, internal combustion engines have maximum acceptable speeds. Exceeding these speeds can cause great damage to the engine and adversely affect safety. Engine operating speed is constantly monitored by the system and any overspeed condition triggers the actuation of the air shut off valve.

Figure 3:
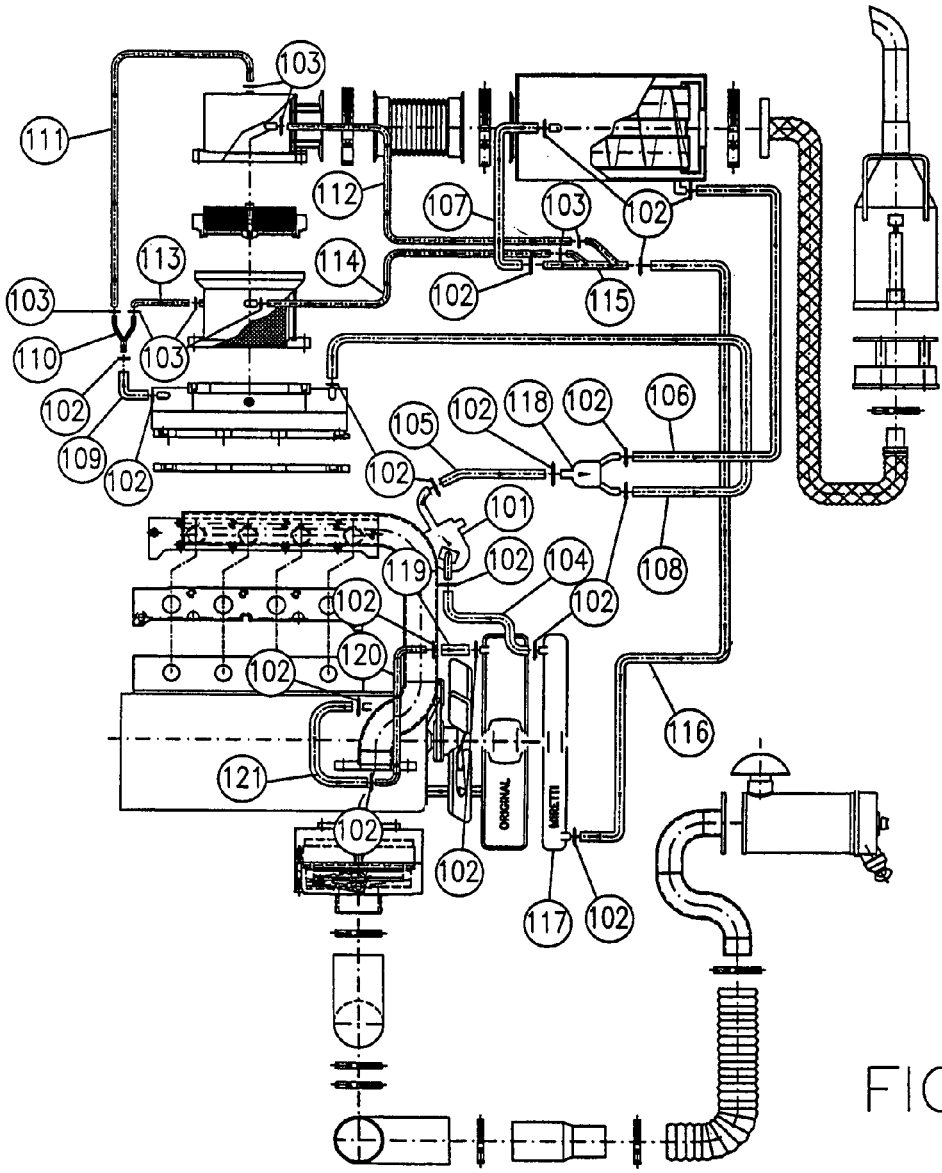
FIG. 3 is a block diagram of a cooling system for use in systems embodying the invention.

Selected components of the cooling assembly shown in FIG. 3 are identified by respective reference characters whose general, brief, descriptions are given in Table II, attached. FIG. 3 shows various components of the cooling system supplying coolants to the components of the intake/exhaust system of FIGS. 2 and 4. Systems embodying the invention include an additional radiator 117 for holding additional coolant and a pumping system dependent from and operated by a pump 101 for causing the coolant to pass along the surfaces of selected components of the exhaust system to ensure that the external surface temperature of the components is below a specified level and, likewise, that the temperature of the exhaust gases is below a specified level.

Figure 4:
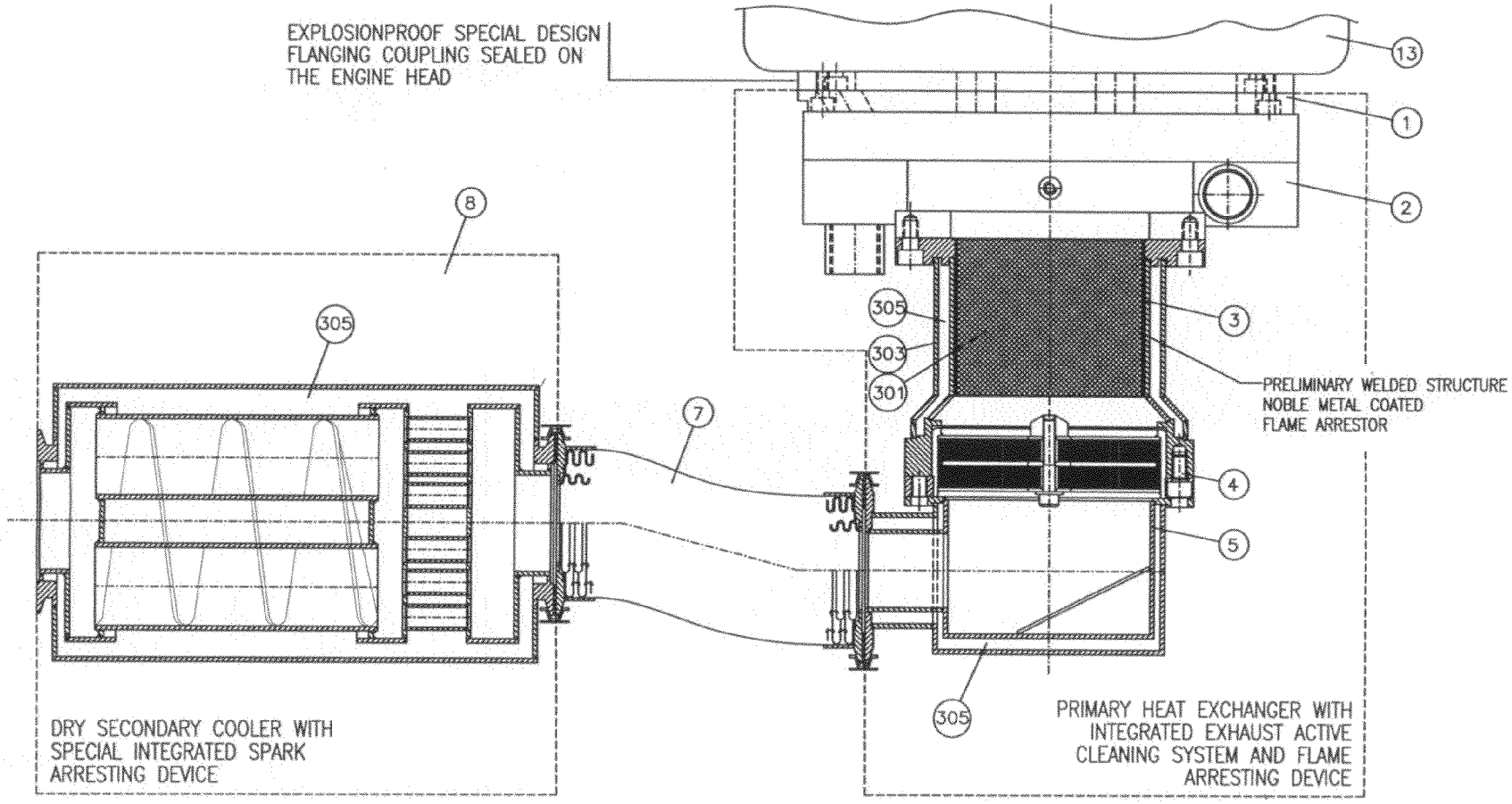
FIG. 4 is an expanded view of the primary and secondary flame arrestors (heat exchangers) and of the flame-arrester-oxidizing device shown in FIG. 2.

FIG. 4 shows in expanded form the cylinder head 13 from the engine coupled via an explosion proofing specially designed flange 1 to the exhaust system. A first section 100 of the exhaust system includes the primary heat exchanger 2, noble metal (e.g., platinum) coated preliminary flame arrestor filter oxidizer 3, the secondary flame arrestor 4 and the coupler 5. The output of coupler 5 (which is also the output of section 100) is coupled via tubing 7 to "dry" secondary cooler 8 which also includes a special spark arresting device.

The primary heat exchanger 2 functions to lower the temperature of the gases exiting the engine. For example, heat exchanger 2 can lower the temperature of the exhaust gases from 400 degrees Centigrade to 200 degrees Centigrade. The output of heat exchanger 2 is then passed to, and through, flame arresting and oxidizing device 3. As described below, flame arresting device 3 also functions to oxidize the pollutants in the exhaust fumes. Thus, heat exchanger 2 functions to lower the temperature of the fumes to ensure that the flame arrestor 3 can effectively function as a flame arrester. At the same time, heat exchanger 2 does not lower the temperature of the gases/fumes to device 3 below the level which would inhibit device 3 from functioning as an oxidizer. As is shown in FIG. 4 (and in other figures) a jacket 305 is formed and/or placed over, and around, units 3, 5, and 8 for passing a coolant (e.g., water or any other suitable liquid) around the outer periphery of these units to ensure that the external surface temperature is less than specified amount (e.g., 90 degrees centigrade).

Figure 6A:
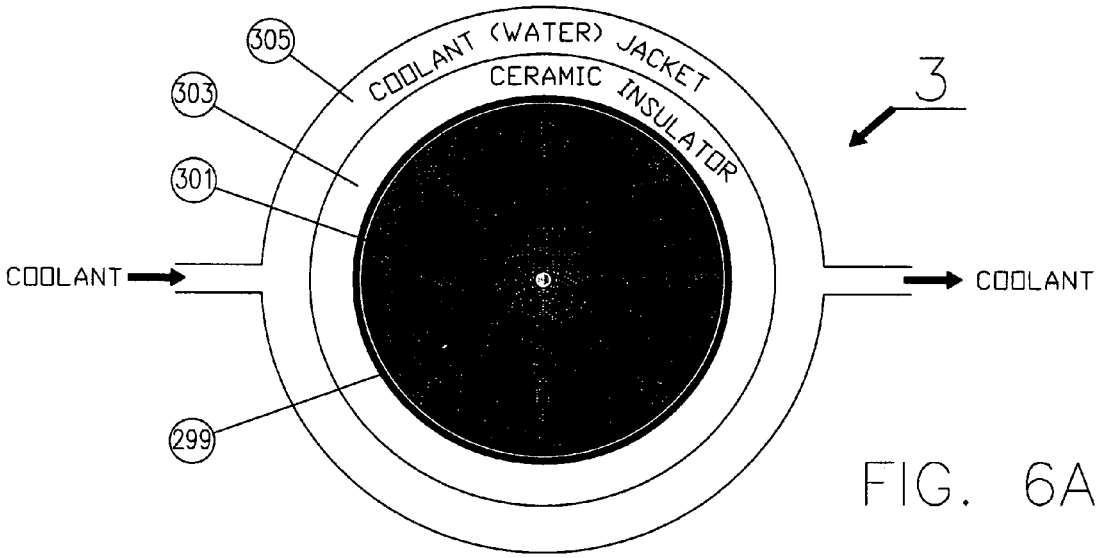
FIGS. 6A and 6B are two additional, different, views of the flame-arrester-oxidizing device of FIG. 5.
Figure 6B:
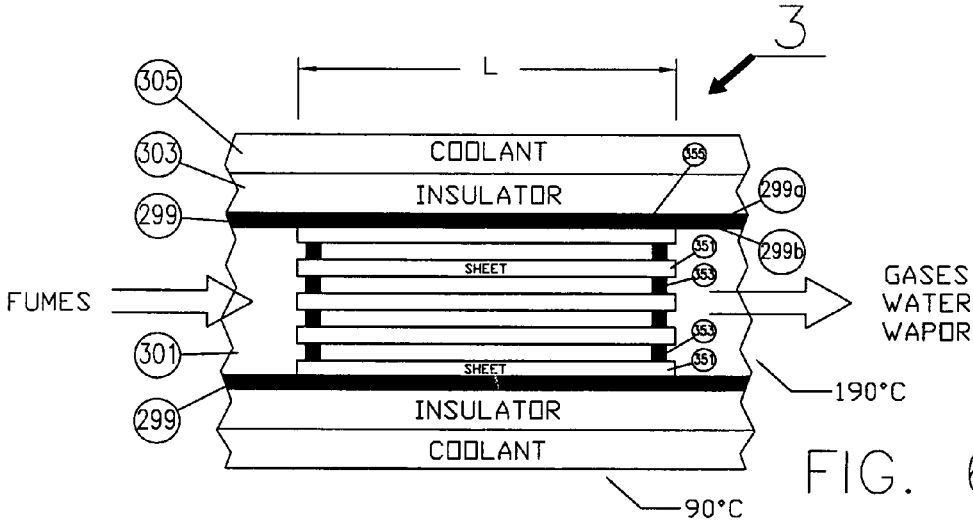
Figure 7A:
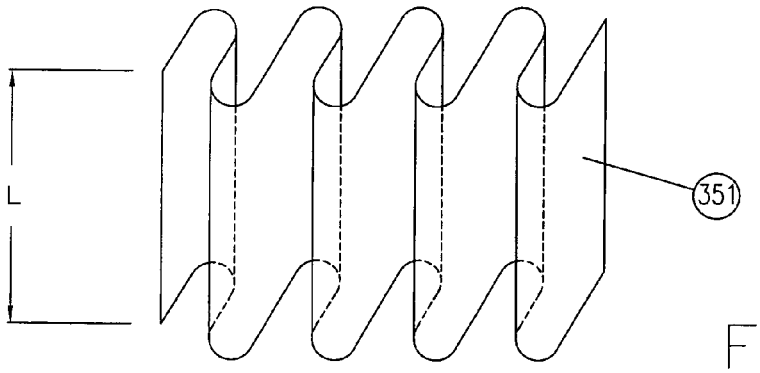
FIG. 7A illustrates the corrugation of a sheet of material used to form a filter for use in practicing the invention.
Figure 7B:
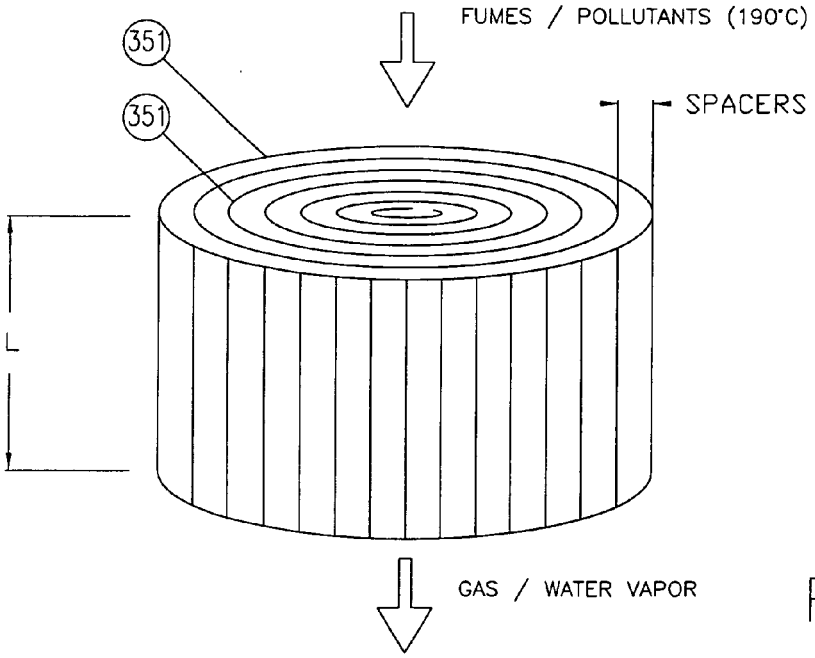
FIG. 7B illustrates the rolling of the corrugated sheets to form a filter.

The flame arrester 3 includes a structure providing a passageway for the "hot" exhaust fumes to pass from heat exchanger 2 to succeeding portions of the exhaust system with many pollutants vaporized. The passageway may be of any suitable shape for allowing the passage of the exhaust gases and fumes. For ease of description the structure is referred to herein as a duct, but it should be evident that it may be also be referred to as a pipe, tube, channel or any like structure. As shown in FIGS. 6A and 6B, the duct has a wall or shell 299, the outer surface of the wall/shell being identified as 299*a* and the inner surface of the wall/shell being defined as 299*b*. The inner surface 299*b* of the wall/shell defines an opening or space through and along which the exhaust fumes and gases pass. The wall/shell 299 of the duct may be formed of special carbon steel or like materials to provide the desired strength and sturdiness. The area of the opening can be made to vary over a very wide range (e.g., from less than 200 square millimetres to more than 5000 square millimetres). The length of the duct can also be made to vary over a very wide range (e.g., from less than 100 millimetres to more than 2000 millimetres).

Figure 5:
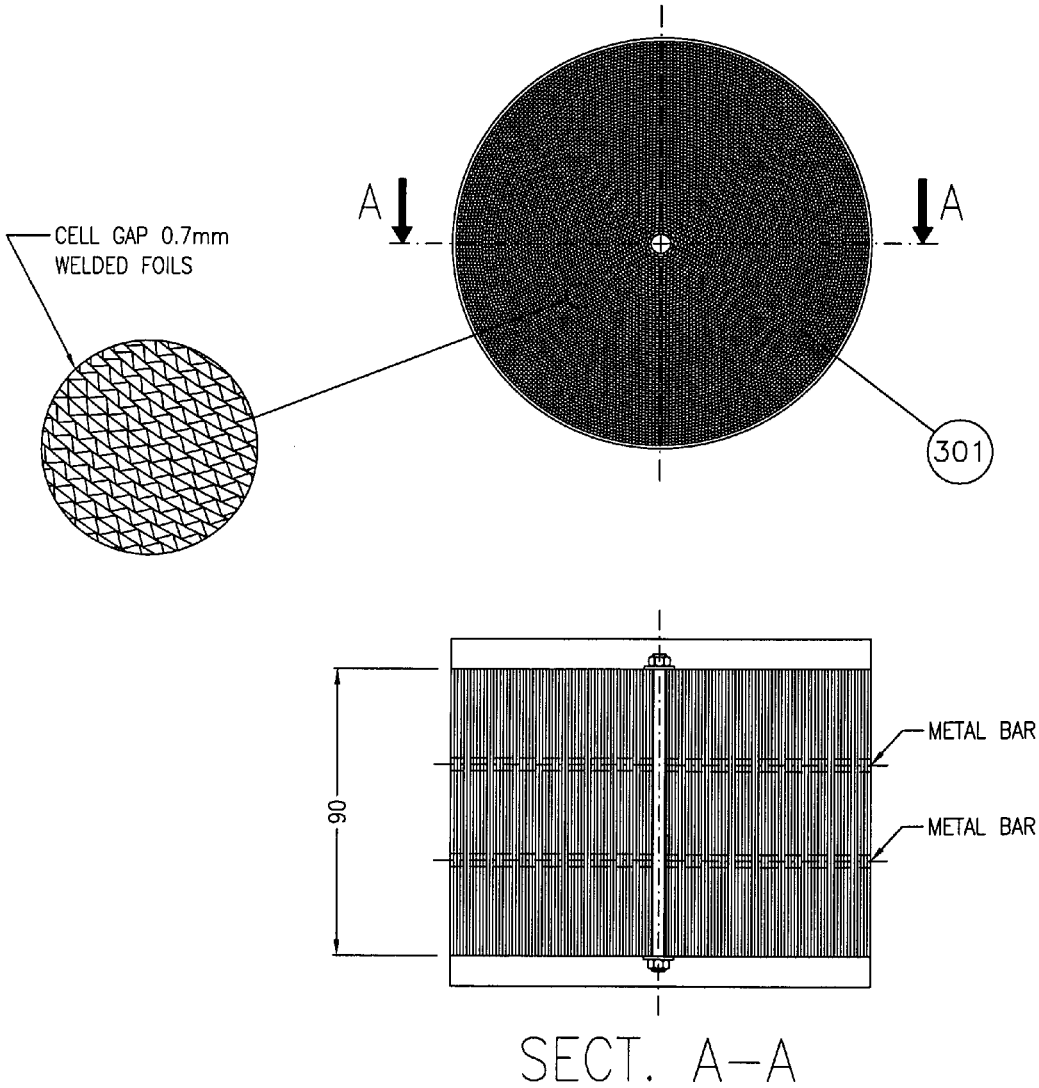
FIG. 5 is a more detailed view of part of a flame-arrester-oxidizing device embodying the invention.

Attached to, and located across, the inner surface 299*b* of the duct wall/shell 299 are corrugated metal (e.g., corrugated sheet metal) foils forming a mesh 301 (as shown in FIGS. 5, 6A, 6B, 7A and 7B) which are constructed and welded together to render the structure robust and to also function as a flame arrester. The density of the cells (see FIG. 5 showing a gap of 0.7 mm between the metal sheets) and the length of the foils (see FIGS. 6A-B & 7A-B) and the length of the flame arrestor 3 may be controlled to achieve the desired level of flame arresting.

The metal foils (sheets) 351 of the flame arrestor 3 are coated with a noble metal (e.g., platinum or palladium, or any like metal which is suitable to sustain oxidation), by a selected procedure, to oxidize the fumes and gases passing through the interior portion of the flame arrester 3 as shown in FIGS. 6A and 6B. The temperature of the gases and fumes within the interior portion of the flame arrestor will generally be at a temperature which is sufficiently high (e.g., 190 degrees Centigrade) to ensure that the pollutants within the exhaust stream are oxidized. The resultant moisture/steam can pass through the back end of the duct to succeeding sections of the exhaust system.

The interior portion (i.e., the space or opening formed by and or between the inner surfaces of the walls/shell of the duct) of the flame arrestor 3 (see FIGS. 5, 6A-B & 7A-B) presents a re-enforced mesh-like structure 301. Foils 351 extending from one interior wall to another define "cell" spacings 353 whose size can be controlled (i.e., the spacings can be made larger or smaller). The size of the cells and the length of the oxidizer define important features of this invention. The cell size needs to be large enough to allow a smooth flow of exhaust gases without appreciably increasing the engine back pressure. The interior surface area of the cells need to provide sufficient contact area between the exhaust gases and the catalyser to permit the desired chemical reactions resulting in significant reduction of noxious fumes. Additionally, the cell assembly needs to have adequate mechanical strength in radial, longitudinal and cylindrical directions, as illustrated with the metal bars in FIG. 5 and rods 355 in FIG. 6B. The speed and the mass of the exhaust gases can collapse a mechanically inadequate cell assembly very quickly rendering the system inoperable and useless.

One embodiment of a foil structure suitable to form a flame arrester/oxidizer in accordance with the invention is shown in FIGS. 5, 6A, 6B, 7A and 7B. A roll of corrugated (grooved or wavy) metal sheets suitably plated with oxidizing metal is spirally (helically) spread out across the interior opening and along the length of the duct to form a three dimensional spiral of the sheets extending about each other across the duct opening and generally parallel to the duct. Spacers 353 may be inserted between the sheets to provide a desired spacing between them. The length L of the roll, or sheet, may be varied depending on the desired length of the flame arrester/oxidizer. The spacers 353 are dimensioned to maintain a desired spacing between the sheets. The sheets may be securely and firmly attached via suitable methods (e.g., welding) to each other and to the walls of the duct. The corrugated sheets fixedly attached across the inner wall surface(s) of duct present what appears as mesh 301 to the gases/fumes.

The size of the cells, i.e., their spacing, as illustrated in FIG. 5, may be made large enough to allow particles which have not been oxidized to pass through, while blocking larger particles. Consequently, the flame arrester 3 functions as a self cleaning oxidizer since it oxidizes the pollutants in the exhaust fumes stream and allows particles below a given size to pass through. The flame-arrestor-oxidizer 3 thus does not have to be cleaned often and requires little maintenance. This is highly advantageous since the flame-arrestor-oxidizer 3 is not readily accessible. The cell spacing may vary from less than 0.1 mm to more than 2 mm. The length L of the mesh may range from less than 8 mm to more than 200 mm.

Thus, as shown in FIGS. 2 and 4, a small primary heat exchanger 2 is located before the noble metal coated flame arresting device 3 to obtain a first stage cooling of the fumes before they enter the self cleaning flame arresting device 3. Cooling the very hot exhaust gases from a very high temperature (e.g., 400 degrees centigrade) to an intermediate level (e.g., 200 degrees centigrade) extends the life of oxidizer 3 and enables it to be designed to operate optimally. Thus, as shown in the Figures (2, 4), the emission is first supplied to the small primary exchanger 2 and then to the self cleaning flame arrester 3. The oxidizing flame arresting device 3 (see FIGS. 3, 6A and 6B) is externally water jacketed to obtain reduced external surface temperature (e.g., 90 degrees Centigrade) and is internally specially insulated to keep the internal heat sufficiently high to allow for the self regeneration (oxidation of the exhaust gases) and fumes cleaning. Thus, while the external surface temperatures of the components in, and along, the exhaust system are maintained below a specified level, the internal temperature of oxidizer 3 is insulated from the coolant and will generally be at a temperature which allows oxidation and self cleaning of the pollutants.

In FIGS. 6A-6B, a ceramic insulator 303 is shown formed along and around the outer wall of duct wall/shell 299. A jacket 305 is formed or mounted around and along the ceramic insulator 303. As shown in FIGS. 6A-6B, a coolant which may be water, or any other suitable liquid, is passed through and along the jacket 305 to ensure that the temperature on the external side of the jacket 305, in direct contact with the surrounding air, is generally below a desired or regulated temperature (e.g., 90 degrees centigrade). The insulator layer 303 functions to isolate the coolant from the duct to allow the temperature within the duct to be at a temperature (e.g., 190 degrees centigrade) which will allow oxidation of the gases and fumes as they pass through and along the mesh 301. Thus, as shown in FIG. 6B, the fumes into the duct exit generally as water vapour and gas. The length of the arrester 3 is selected to ensure that sparks and flames from the engines do not pass or extend past the end region of the duct.

The combination of primary heat exchanger 2, flame arrester 3 and additional heat exchanger 4 functions as an explosion proofing device to contain the explosions and high temperatures of the exhaust system of the engine. Also, the flange 1 is attached to the cylinder head 13 via a special method and attaching means to obtain a very compact closed joint. The integrity of this joint is critical. Repeated cycles of higher and lower temperature exhaust cycles caused by varying engine loads inherent in most work environments can cause the sealing material to crack. This action can initially diminish and eventually render worthless the sealing effectiveness. Loss of sealing would release high temperature exhaust gases in hazardous areas negating the benefits of explosion proof solutions and creating unsafe work environment. Sealing methods used by prior art in this area are inadequate for long term durability of engines. The combination of a special coupling design and the choice of sealant in systems embodying the invention ensures against sealing degradation resulting in safe operations and long term durability. The sealant used in the invention is an acrylic based adhesive particularly suitable for high temperature applications. It retains its shape and sealing capacity over a wide range of temperatures, is resistant to oils, fuels, lubricants and chemicals. Additionally, it can withstand high pressures without degradation in sealing effectiveness.

The output from flame arrestor/heat exchanger 4 and coupler 5 is passed through piping 7 to secondary cooler 8. The secondary cooler 8 is specially constructed to further reduce the temperature of the exhaust fumes and to act as a spark arrestor. The internal construction has a very high efficiency in reducing the exhaust temperature by a double stage cooling device constructed by parallel metal pipes acting as radiators. Furthermore, in the internal side of the pipes an helical metal structure is located to increase the cooling efficiency and to act as a spark arrestor system. Thus, for example, cooler 8 functions to reduce the temperature of particles passing through from the primary heat exchange section. Like the design of the flame arrestor 3, spark arrestor 8 is also designed around the principle of dry cooling. This makes the system compact and provides for far greater cooling than the wet cooling systems found on some machines.

In systems embodying the invention, particles which have not been oxidized by, and in, flame arrestor 3 may pass through and reach particle filter 12. Filter 12 will block particles exceeding specified values from being exhausted to the atmosphere. Note that filter 12 is much more accessible than device 3 and it is much easier to change this filter than to change flame arrestor/oxidizer 3.

Functioning of the System:

An important aspect of the system is to ensure that the exhaust apparatus of the engine is explosion proof and that the temperature of the exhaust fumes is reduced to be less than a specified value for operation in a potentially explosive atmosphere. Also, the exhaust emissions are drastically decreased and the flame arresting device is automatically cleaned.

The cooling system is considered, and referred to as, a "dry" system as the exhaust fumes do not come in direct contact with the cooling liquid. As shown in FIG. 3, a closed pressurized cooling apparatus is provided with an individual radiator. The coolant is circulated into two cooling modules by a dedicated belt actuated water pump.

The fumes from the engine head exit ports pass first through the primary heat exchanger explosion proof flanged to the cylinder head and then into the spark arresting cooler.

The reduction of the diesel engine pollutants is extremely drastic and can be in the range noted below:

(a) carbon monoxide (CO) reduction is approximately 90%, (b) total hydrocarbons (HC) are reduced approximately 70%, (c) nitrogen oxides (NOx) are diminished by approximately 35%, (d) diesel particulate matter (DPM) is diminished by approximately 40%.

Advantages of the System:

The exhaust system embodying the invention integrates an emission control device into an explosion proof fumes cooling system. Furthermore, the system has a high degree of automatic self cleaning and therefore it does not need extensive routine maintenance. Systems embodying the invention overcome the disadvantage of known flame arrestors which need to be cleaned every 8 to 12 hours and which requires physically removing the flame arresting device, burning off the particulate matter and reattaching the flame arrestor on the machine. Employing prior art structures and processes would take at least one and a half hours and presents the following disadvantages: (1) the necessity to have an on site service person available to perform this task every eight to twelve hours; (2) incurring costs for cleaning apparatus; (3) incurring premium labour charges to carry out this task; and (4) most importantly, there is a forced equipment down time several times a day interrupting operations that require engine power around the clock. The total cost of these activities over the useful life of the equipment generally exceeds the initial cost of the engine. Apparatus embodying the invention eliminate these disadvantages.

The apparatus embodying the invention is also very compact and ergonomically designed and easily fits into the engine compartments. The compactness of this apparatus is very appealing to machinery manufacturers. A mobile piece of equipment driven by an internal combustion engine is always pressed for physical space around the engine. The dry cooling and especially designed heat exchangers associated with this system permit installation of flame proof solutions in applications previously encumbered by space constraints. Systems embodying the invention provide commercially viable solutions and open new markets for explosion proof solutions.

The dramatic reduction in carbon monoxide, hydrocarbons, nitrous oxides and diesel particulate matter vastly expands the indoor areas where diesel powered equipment can be operated. This is expected to result in meaningful increases in operational efficiencies in many applications.

Any change in engine back pressure is minimal and therefore the engine maintains a good performance. The practical advantages of the novel system are evident when compared to presently available explosion proof systems.

The invention is applicable for use with the exhaust from any type of internal combustion engine, including, but not limited to, a diesel engine, a liquid propane engine, a compressed natural gas engine and a gasoline (petrol) engine.

TABLE I components of intake/exhaust assembly in FIGS. 2 and 4

| Item No. | Description/function |
|---|---|
| 1 | Exhaust engine sealed sepecial falnge |
| 2 | Primary heat exchanger |
| 3 | Platinum coated preliminay flame arrester |
| 4 | Secondary flame arrester |
| 5 | Flow deflector |
| 6 | clamp |
| 7 | Flexible pipe |
| 8 | Secondary heat exchanger (integrated spark arrester) |
| 9 | Pipe with flange |
| 10 | Clamp |
| 11 | Frame |
| 12 | Particle filter |
| 13 | Intake engine sealed special flange |
| 14 | Intake manifold |
| 15 | Intake falme arrester and intake air shut down valve |
| 16 | clamp |

TABLE I-continued components of intake/exhaust assembly in FIGS. 2 and 4

| Item No. | Description/function |
|---|---|
| 17, 18 | Elbow |
| 19 | Reducer |
| 20 | Flexible pipe |
| 21 | Pipe with flange |

TABLE II components of cooling assembly in FIG. 3

| Item No. | Description/function |
|---|---|
| 101 | Pump |
| 102, 103 | clamp |
| 104, 105, 106, 107, 108, 109 | Hose |
| 110, 115 | Y manifold |
| 111, 112, 113, 114, 116, 119 | Hose |
| 117 | radiator |
| 118 | Manifold—flow divider |
| 120 | Steel pipe |
| 121 | hose |

What is claimed is:

1. An anti-explosion and fire arrester system for use with an internal combustion engine comprising:

means coupling a duct to the engine for passing and processing the exhaust gases and fumes emitted by the engine; said duct having an enclosure with an input end for receiving the exhaust gas and fumes and having an output end for passing the exhaust gases and fumes processed within the duct; the duct enclosure forming a wall whose inner surface defines an opening through and along which the gas and fumes are contained and flow;

a filter structure coated with a metal for enabling the oxidation of the gases and fumes securely mounted across the opening of the duct in a direction generally perpendicular to the flow of the gases and fumes;

an insulator layer mounted about and along the outer surface of the wall of the duct; and a jacket for carrying a coolant mounted above and about the insulator layer whereby the temperature on the external side of the jacket, facing away from the duct, is less than a specified value while the insulator layer insulates the duct from the jacket to allow the temperature within the duct to have a value to enable oxidation of the gases and fumes to occur; and wherein the means coupling the duct to the engine includes a primary heat exchanger connected between the internal combustion engine and the input end of the duct and wherein the output end of the duct is connected to an additional heat exchanger and spark arrester; and wherein the additional heat exchanger is coupled to a still further dry cooling and spark arresting device; and wherein the additional heat exchanger and the still further dry cooling and spark arresting device are jacketed with a jacket for carrying a coolant to maintain the temperature on the external side of the jacket below said specified value.

2. An anti-explosion and fire arrester system for use with an internal combustion engine as claimed in claim 1 wherein the filter structure is a mesh-like structure extending across the entire opening of the duct and along the length of the duct for a given length to limit sparking at the exhaust end of the duct.

3. An anti-explosion and fire arrester system for use with an internal combustion engine as claimed in claim 2, wherein the filter structure includes corrugated sheets extending along the length of the duct for providing a relatively large surface area to the gases and fumes for enhancing their oxidation and producing water vapor and gases at the output end of the duct, and wherein the corrugated sheets are spaced apart a predetermined distance from each other in order to block particles greater than the given distance from passing through.

4. An anti-explosion and fire arrester system for use with an internal combustion engine comprising:

means coupling a duct to the engine for passing and processing the exhaust gases and fumes emitted by the engine; said duct having an enclosure with an input end for receiving the exhaust gas and fumes and having an output end for passing the exhaust gases and fumes processed within the duct; the duct enclosure forming a wall whose inner surface defines an opening through and along which the gas and fumes are contained and flow;

a filter structure coated with a metal for enabling the oxidation of the gases and fumes securely mounted across the opening of the duct in a direction generally perpendicular to the flow of the gases and fumes;

an insulator layer mounted about and along the outer surface of the wall of the duct; and a jacket for carrying a coolant which is always physically isolated from the exhausted gases mounted above and about the insulator layer, the jacket having an inner surface surrounding the insulator layer and having an outer surface suitable to be exposed to the atmosphere and the space between the jacket's inner and outer surfaces forming an enclosure through which the coolant can flow and the jacket extending the full length of the insulator covered duct for preventing any exhaust gases from flowing through the jacket's inner surface and mixing with the coolant, whereby the temperature on the external side of the jacket, facing away from the duct, is less than a specified value while the insulator layer insulates the duct from the jacket to allow the temperature within the duct to have a value to enable oxidation of the gases and fumes to occur; and wherein the means coupling the duct to the engine includes a primary heat exchanger connected between the internal combustion engine and the input end of the duct and wherein the output end of the duct is connected to an additional heat exchanger and spark arrester; and wherein the additional heat exchanger is coupled to a still further dry cooling and spark arresting device; and wherein the additional heat exchanger and the still further dry cooling and spark arresting device are jacketed with a jacket for carrying a coolant to maintain the temperature on the external side of the jacket below said specified value.

5. An anti-explosion and fire arrester system for use with an internal combustion engine as claimed in claim 4 wherein the internal combustion engine is one of a diesel, a liquid propane, a compressed natural gas engine and a gasoline engine.

6. An anti-explosion and fire arrester system for use with an internal combustion engine as claimed in claim 4 wherein the coolant is a liquid coolant and wherein the duct, insulator and jacket for carrying the liquid coolant are interconnected to form a dry cooling and spark arresting device.

7. An anti-explosion and fire arrester system for use with an internal combustion engine as claimed in claim 4 wherein the primary heat exchanger is connected to the engine via an explosion proof flange.

8. An anti-explosion and fire arrester system for use with an internal combustion engine as claimed in claim 7 wherein the explosion proof flange includes a high temperature acrylic based sealant.

9. An anti-explosion and fire arrester system for use with an internal combustion engine as claimed in claim 4 wherein the filter structure is a mesh-like structure extending across the entire opening of the duct and along the length of the duct for a given length to limit sparking at the exhaust end of the duct.

10. An anti-explosion and fire arrester system for use with an internal combustion engine as claimed in claim 9 wherein the filter structure includes corrugated sheets extending along the length of the duct for providing a relatively large surface area to the gases and fumes for enhancing their oxidation and producing water vapor and gases at the output end of the duct.

11. An anti-explosion and fire arrester system for use with an internal combustion engine as claimed in claim 10 wherein the corrugated sheets are spaced apart a predetermined distance from each other in order to block particles greater than the given distance from passing through.

12. An anti-explosion and fire arrester system for use with an internal combustion engine as claimed in claim 10 wherein the duct is formed of special carbon steel material and wherein the filter structure is formed of corrugated sheet metal material and wherein the metal coating the filter structure is a noble metal.

13. An anti-explosion and fire arrester system for use with an internal combustion engine as claimed in claim 10 wherein the area of the duct opening is in the range of 200 square millimeters (mm) to 5000 square mm and wherein the length of the duct is in the range of 100 mm to 2000 mm; and wherein the length of the filter structure extends for a predetermined distance along and within the duct.

14. An anti-explosion and fire arrester system for use with an internal combustion engine as claimed in claim 10 wherein the filter structure includes a roll of corrugated sheets extending across the duct opening with reinforcing rods holding the spacing between the sheets and attached to the wall of the duct.

* * * * *